United States Patent [19]

Ginsburg

[11] 3,980,028

[45] Sept. 14, 1976

[54] INTERCHANGEABLE SEE-THROUGH AND OPAQUE INSERTS FOR MUFFLE FURNACE

[76] Inventor: Leon Ginsburg, 244 Liberty Road, Tappan, N.Y. 10983

[22] Filed: May 30, 1975

[21] Appl. No.: 582,104

[52] U.S. Cl. ..... 110/173 R; 126/200; 432/250

[51] Int. Cl.[2] ..... F23M 7/00

[58] Field of Search ..... 432/120, 250; 126/200; 110/173 R, 179

[56] References Cited

UNITED STATES PATENTS

| | | | |
|---|---|---|---|
| 1,802,000 | 4/1931 | Brooke | 432/250 |
| 2,002,241 | 5/1935 | Forde | 432/120 |
| 2,733,707 | 2/1956 | Skibiski | 126/200 |
| 2,920,585 | 1/1960 | Grossman et al. | 110/179 |
| 3,800,716 | 4/1974 | Berger | 110/173 |

*Primary Examiner*—Kenneth W. Sprague

[57] ABSTRACT

Prior to the present invention, there has not existed any equivalent to the present furnace door for a porcelain furnace in which door there is provided a lineal passage for alternate insertion of an opaque insulator insert and a viewing structure defining a lineal see-through channel having a transparent heat barrier at an outer end thereof utilizing air space within the channel extending to an interior-furnace end for insulating air, and an outer end of the passage defining female step(s) and the respective inserts each respectively including a male step(s) which mates flushly with the female step when inserted to provide an improved heat seal for the inserts each respectively.

7 Claims, 4 Drawing Figures

INTERCHANGEABLE SEE-THROUGH AND OPAQUE INSERTS FOR MUFFLE FURNACE

This invention relates to a muffle furnace see-through door device.

BACKGROUND TO THE INVENTION

Heretofore, it has been necessary to open a furnace door, most often for this type furnace there being no hinge but requiring a removal of the entire door from its inserted heat-sealed position and state, or alternately with the see-through door a major degree of heat loss has been a disadvantage, through the transparent heat barrier such as is disclosed in U.S. Pat. No. 3,800,716 for example, where the barrier is located at the end of the see-through channel adjacent the interior of the furnace heating space, such that the transparent barrier becomes highly heated and the air within the channel space exterior to the interior of the furnace space, is in contact with the exterior surface of the transparent barrier and becomes highly heated with resulting air currents such that the heated air escapes to exterior space through the open end of the see-through channel. Also, it has been found in the development of the present invention, that there is a large heat loss in the absence of a proper seal between an insert and a receiving structure defining space communicating with an inner furnace of a muffle furnace such as a porcelain furnace. It has heretofore been a difficult choice between having a provision for viewing within the furnace and retaining heat for quick heating and more efficient operation devoid of viewing capability without having to remove the door.

SUMMARY OF THE INVENTION

Objects of the present invention include the overcoming and/or avoiding of one or more problems and difficulties of the types discussed above.

Another object is to provide for both retained heat and high efficiency of opertion together with an observation capability.

Another object is to obtain an improved heat seal between insert structure(s) and insert-receiving structure(s) defining space communicatable with a furnace interior heating space with which the insert structure is in contact.

Other objects become apparent from the preceding and following disclosure.

One or more of the objects are obtained by the invention as defined herein.

Broadly the invention may be defined as a muffle furnace such as preferably a porcelain furnace, of typically conventional or desired shape, design and structure, with heating elements and optional vacuum elements similarly being conventional or as desired, the invention being in the door of such preferred combination, the furnace door defining therethrough from and through an exterior surface to and through an interior surface in communication with iterior heating space, a substantially lineal passage shaped to be receivable of alternately and interchangeably opaque insert and a see-through insert including a transparent barrier, the transparent barrier being preferably mounted at a distal end of the channel adjacent an exterior space spaced away from a proximal end of the channel which proximal end is adjacent the heated furnace interior space when the see-through insert is in an inserted state. Also, at an outer end of the passage-defining structure of the door, a stepped female receiving structure is defined, and receivable therein is a male stepped structure for each of the insert structures at a distal end thereof, such stepped relationship having been discovered to effect a good seal significantly reducing heat escape and loss between the outer insert surfaces and the passage-defining structure.

In so far as the location of the transparent barrier within the channel of the see-through insert, it has been found that the temperature of the barrier when located at the proximal end adjacent the interior furnace heating space, is very high as compared to ambient temperature substantially when located at the distal end adjacent exterior space such that air within the channel interior to the transparent barrier (located at the exterior end of the channel) serves to insulate the transparent barrier from high temperature, as well as the insulating air being trapped within the channel and thus not lost by air currents to exterior air. Another advantage of the present discovery is that by having the transparent barrier located at the distal end (adjacent exterior space) with the accompanying low temperatures to which it will be subjected—as compared to high temperatures if located at the proximal end of the channel, mere low cost glass barrier may be utilized with the present invention as contrasted to expensive high cost quartz or the like for a transparent barrier if placed adjacent the furnace interior space.

The alternately intermittently insertable opaque structure and see-through insert make possible quick substitution of the see-through insert at desired time(s) while at other times retaining the highly insulative insert inserted within the door passage.

also, as a preferred accessory, each of the inserts, as well as the door outer exposed surfaces include appropriate handle structure associated therewith, such as preferably side-by-side space-apart apertures within the outer surface of each of sizes and dimensions making possible the insertion typically of conventional grasping tongs or the like as desired, for the grasping and removal of the door and/or of the respective inserts from the door structure.

The invention may be better understood by making reference to the following Figures.

THE FIGURES

DETAILED DESCRIPTION

Figure 1:
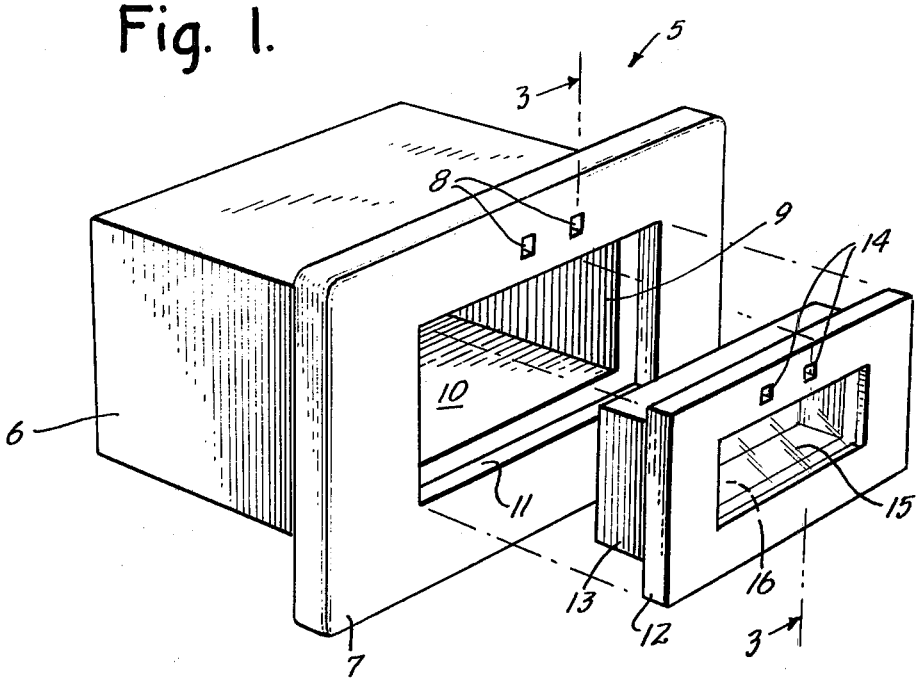
FIG. 1 illustrates in exploded view a front perspective view of a door of the present invention, with a see-through insert as a part thereof
Figure 2:
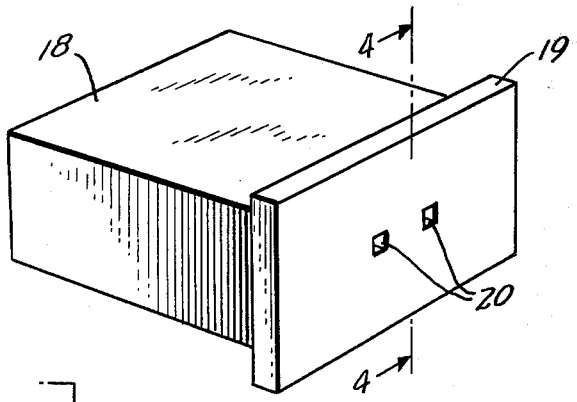
FIG. 2 illustrates in front perspective view an alternate opaque insert to the one of FIG. 1, when full heat of the furnace is to be retained and no see-through is desired
Figure 3:
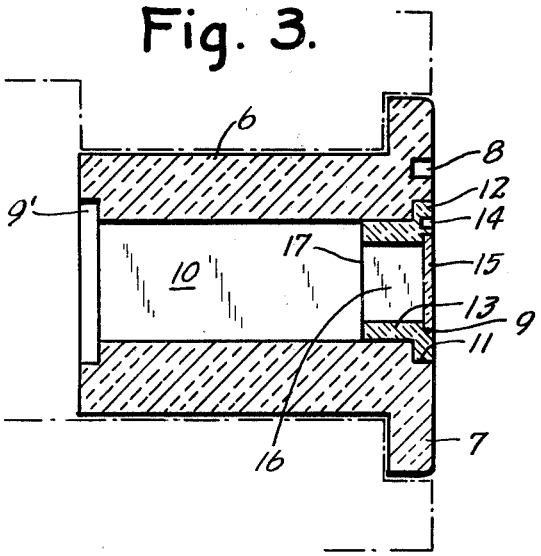
FIG. 3 illustrates a side cross-sectional view as taken along lines 3—3 of FIG. 1.
Figure 4:
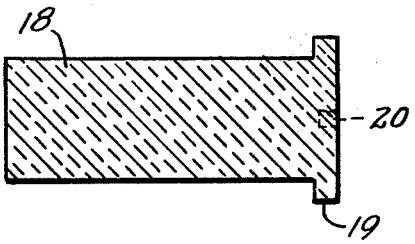
FIG. 4 illustrates a side cross-sectional view as taken along lines 4—4 of FIG. 2.

In greater detail, FIGS. 1 through 4 illustrate a common embodiment of the invention, as a combination 5 as represented by the insert door structure 6 with its outer heat-retaining flange 7 as best understood by reference to FIG. 3 showing the furnace in phantom. Apertures 8 in the flange 7 provide for grasping the door structure 6 with tongs for the removal thereof from the furnace. Opening 9 is continuous with channel 10 and the structure thereof defines step 11 into which flange 12 seats when the insert structure 13 is inserted into the channel 10. Apertures 14 are for the tong grasping of the insert flange 12 for insertion and removal of the structure 13 from the channel 10, and glass 15 is mounted at the opening of the channel 16. FIG. 3 shows the opening end of channel 10. FIG. 2 illustrates the opaque structure 18 with its flange 19 devoid of any see-through window or channel, and the apertures 20 provide for tonge grasping thereof for insertion and removal to and from space 10.

It is within the scope of the present invention to make such variations and changes and substitution of equivalents as would be apparent to a person of ordinary skill.

I claim:

1. A muffle furnace device comprising in combination: a door means for providing access to and for closing off furnace interior heating space, the door means defining an insertable structure insertable sealable within a furnace access opening with the door structure having inner and outer faces with a passage extending substantially lineally therebetween such that an interior of a furnace space is viewable through the passage from an exterior thereof when the door means is inserted within a furnace access opening; first and second insert structures each having a configuration for sealably inserting within the door structure defining said passage, one of the first and second insert structures being substantially opaque and composed substantially of insulating composition, and the other of the first and second insert structures having a substantially lineally extending channel extending between and through inner and outer faces thereof such that when inserted within the passage, interior space of a furnace is viewable from an exterior thereof, the other of the first and second insert structures including a transparent barrier structure mounted within the channel substantially transversely to a longitudinally elongated axis of the channel providing thereby insulation between interior compartment space and exterior space, whereby alternately intermittently the first insert structure may be removed and replaced by the second insert structure thus providing for intermittent observation interior space of a furnace without excessive heat loss.

2. A muffle furnace device of claim 1, in which said transparent barrier structure is mounted at an outer end of the channel substantially adjacent exterior space such that interior channel space located in an interior direction from the transparent barrier structure insulates the transparent barrier structure from interior furnace structure space whereby heat loss through the transparent barrier structure is minimized.

3. A muffle furnace device of claim 2, in which handle means for grasping and removing of each respectively of the first and second insert structures is provided as a part of the first and second insert structures.

4. A muffle furnace device of claim 3, in which said handle means comprises spaced-apart apertures defined in an outer face of each respectively of the first and second insert structures such that grasping tongs are insertable thereinto, for the gripping thereof such that each respectively of the first and second insert structures are removable and insertable within the passage of the door structure.

5. A muffle furnace device of claim 4, in which structure of said passage at an outer exterior end thereof defines a stepped configuration and in which each of the first and second insert structures define each respectively a male stepped structure at an exteriorly located end thereof seatable within a stepped surface of the stepped configuration of the structure of the passage.

6. A muffle furnace device of claim 5, including a muffle furnace defining a furnace access opening.

7. A muffle furnace device of claim 1, including a muffle furnace defining a furnace access opening.

* * * * *